US006155848A

United States Patent [19]

Lin

[11] Patent Number: 6,155,848

[45] Date of Patent: Dec. 5, 2000

[54] AUXILIARY DEVICE FOR ZIF ELECTRICAL CONNECTOR

[75] Inventor: Nick Lin, Hsin-Chuang, Taiwan

[73] Assignee: Hon Hai Precision Ind. Co., Ltd., Taipei Hsien, Taiwan

[21] Appl. No.: 09/394,290

[22] Filed: Sep. 10, 1999

[30] Foreign Application Priority Data

Apr. 9, 1999 [TW] Taiwan ..... 88205506

[51] Int. Cl.[7] ..... H01R 13/44

[52] U.S. Cl. ..... 439/135; 439/342; 439/940

[58] Field of Search ..... 439/41, 135, 342, 439/940

[56] References Cited

U.S. PATENT DOCUMENTS 5,361,492 11/1994 Miyazawa ..... 439/940
5,383,797 1/1995 Seong et al. ..... 439/940
5,507,657 4/1996 Seto et al. ..... 439/940
5,681,174 10/1997 Correll, Jr. et al. ..... 439/940

*Primary Examiner*—Gary F. Paumen
*Attorney, Agent, or Firm*—Wei Te Chung

[57] ABSTRACT

An auxiliary device comprises a body with a planar surface for engaging with a vacuum nozzle. A pair of supporting portions perpendicularly extends from lateral edges of the body and forms a receiving space for receiving the assembled electrical connector. A stand-off portion is formed at a free end of each supporting portion. The height of the stand-off portion is less than the height (diameter) of the solder balls before soldering, and equal to the height of solder balls after soldering. Thus, the height of the solder balls is determined by the height of the stand-off portions and the planarity of the electrical connector is ensured by the stand-off portions. The provision of the stand-off portions also prevents solder wicking.

2 Claims, 4 Drawing Sheets

AUXILIARY DEVICE FOR ZIF ELECTRICAL CONNECTOR

BACKGROUND OF THE INVENTION

The present invention relates to an auxiliary device for a ZIF (zero insertion force) electrical connector, and particularly to an auxiliary device having a flat surface for being engaged by a vacuum nozzle, and having a standoff portion for preventing solder wicking during a soldering process of the connector to a printed circuit board (PCB).

Related conventional electrical connectors are disclosed in Taiwan Patent Application Nos. 81214436; 83203222; 82208450 and 82214129, and U.S. Pat. No. 5,057,031. Referring to FIG. 1, a conventional ZIF electrical connector 6 comprises a base 61 and a cover 62. A plurality of passageways 611 is formed in the base 61 for receiving corresponding contacts 63 therein. A plurality of receiving holes 621 is formed in the cover 62 corresponding to the passageways 611 for receiving terminals of a CPU module (not shown). A cam device 64 is formed between the base 61 and the cover 62 for moving the cover 62 relative to the base 61 whereby the terminals of the CPU module are freely located at withdrawal/insertion positions by the cam device 64. However, a plurality of holes is formed in the top surface of the cover 62, thus the cover 62 is not suitable for automated production since a vacuum nozzle cannot properly attach to the cover 62 during a soldering process. Furthermore, since the conventional ZIF electrical connector is soldered to a circuit board through a SMT (surface mounting technology) process, solder wicking often occurs, which may adversely affect signal transmission.

Thus, there is a need for an auxiliary device for a ZIF electrical connector which can prevent solder wicking during a soldering process of the ZIF connector to a PCB, and which can help the ZIF connector to be soldered to the PCB by an automated soldering process.

BRIEF SUMMARY OF THE INVENTION

A main object of the present invention is to provide an auxiliary device with a planar surface for allowing to be readily attached thereto a vacuum nozzle thereby facilitating an automated soldering process.

Another object of the present invention is to provide an auxiliary device for preventing solder wicking when a ZIF electrical connector is sold(red to a circuit board.

To fulfill the above-mentioned objects, according to a preferred embodiment of present invention, an auxiliary device comprises a body having a planar surface for engaging with a vacuum nozzle. A pair of supporting portions perpendicularly extends from lateral edges of the body and forms a receiving space for receiving the assembled electrical connector. A stand-off portion perpendicularly extends from a free end of each supporting portion. The height of the stand-off portion is less than the height (diameter) of solder balls before soldering, and equal to the height of the solder balls after soldering. Thus, the height of the solder balls is determined by the height of the stand-off portions and the planarity of the electrical connector is ensured by the stand-off portions. The provision of the stand-off portions also prevents solder wicking.

Other objects, advantages and novel features of the invention will become more apparent from the following detailed description when taken in conjunction with the accompanying drawings.

DETAILED DESCRIPTION OF THE INVENTION

Figure 1:
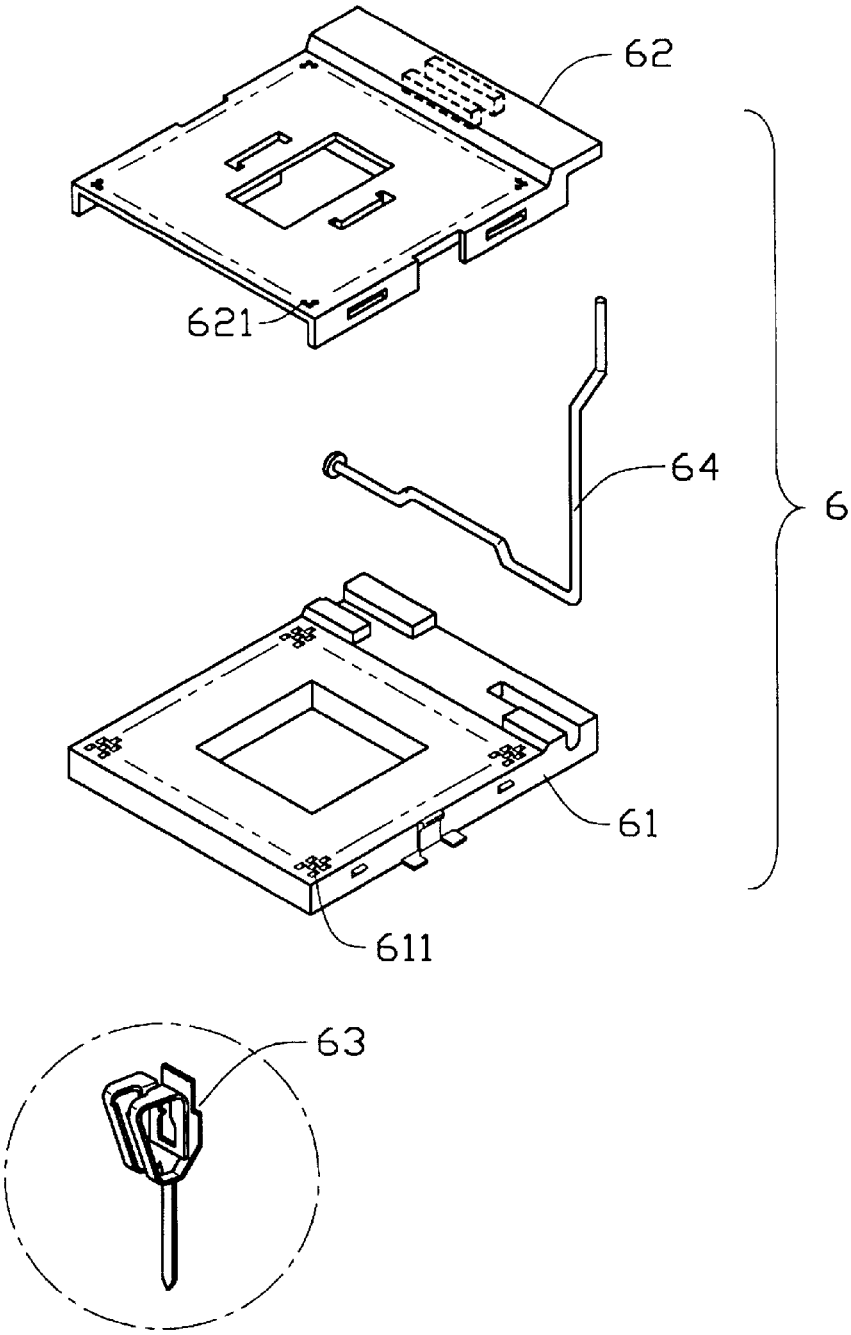
FIG. 1 (PRIOR ART)
FIG. 1 is an exploded view of a conventional ZIF electrical connector.
Figure 2:
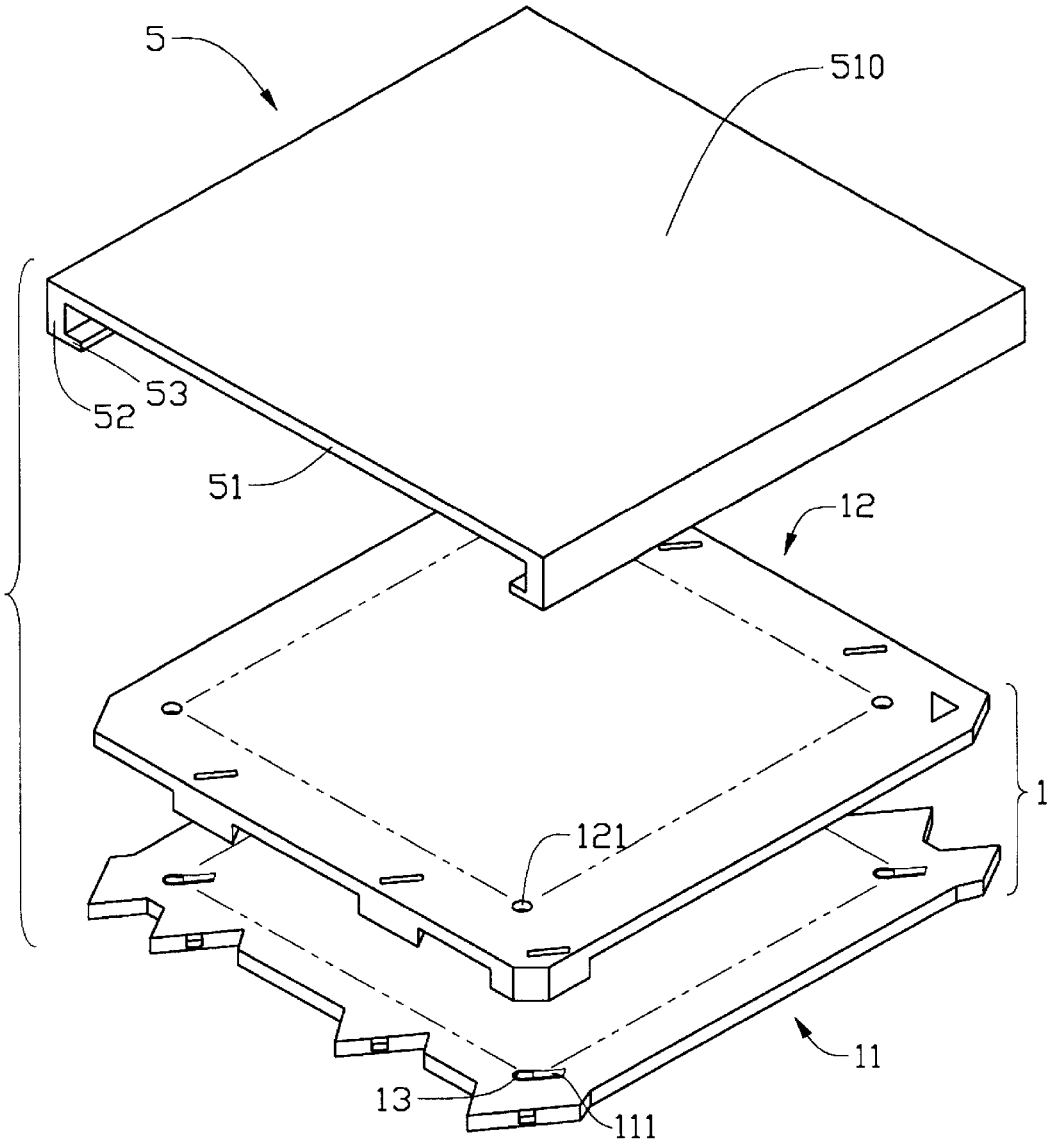
FIG. 2 is an exploded view of a ZIF electrical connector and an auxiliary device in accordance with the present invention.
Figure 3:
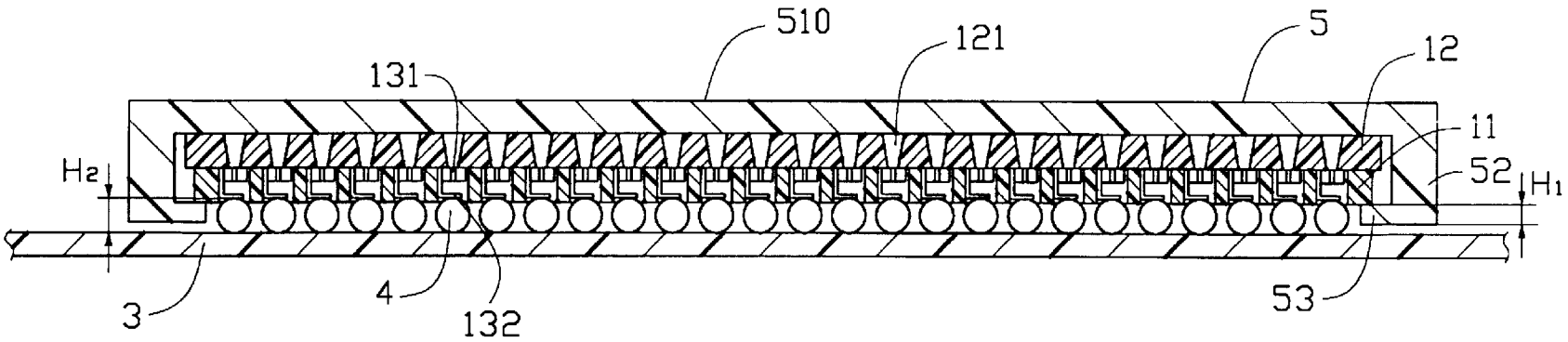
FIG. 3 is a cross-sectional view of the assembled auxiliary device and ZIF electrical connector positioned on a circuit board before soldering.

Referring to FIGS. 2 and 3, an auxiliary device 5 is used for receiving a ZIF electrical connector 1 to facilitate an automated soldering process of the ZIF electrical connector 1. The electrical connector 1 comprises a rectangular base 11 with lengthwise and lateral edges thereof, and a similar rectangular cover 12 mounted on the base 11 wherein the cover 12 may diagonally slide with regard to the base 11. A plurality of passageways 111 is formed in the base 11 for receiving corresponding terminals 13 therein. A plurality of receiving holes 121 is formed in the cover 12 corresponding to the passageways 111 for receiving contacts of a CPU module (not shown) therein. Each terminal 13 comprises a contacting portion 131 for electrically contacting a contact of the CPU module and a soldering portion 132 for being soldered to a solder ball 4 on a circuit board 3. The cover 12 is slidably mounted on the base 11 and moves in a diagonal direction relative to the base 11.

The auxiliary device 5 comprises a body 51 forming a planar surface 510 for engaging with a vacuum nozzle during the automated soldering process. A pair of supporting portions 52 perpendicularly extends from lateral edges of the body 51 and forms a receiving space for receiving the assembled electrical connector 1. The supporting portions 52 confront the lateral edges of the base 11 when the auxiliary device 5 and the base 11 and the associated cover 12 assembled together. Each supporting portion 52 forms a stand-off portion 53 perpendicularly extending inward from a free end thereof for commonly functioning as a holding device and assembling to the connector 6. Since the electrical connector 1 is soldered on the circuit board 3 by an SMT (Surface Mounting Technology) process, the planarity of the electrical connector 1 must be established before being soldered to the circuit board 3. The height $H_1$ of each stand-off portion 53 is less than the height (diameter) $H_2$ of the solder balls 4 before soldering, and equal to the height of solder balls 4 after soldering. Thus, the height of the solder balls 4 is determined by the height Hi of the stand-off portions 53 and the planarity of the electrical connector 1 is ensured by the stand-off portions 53.

Figure 4:
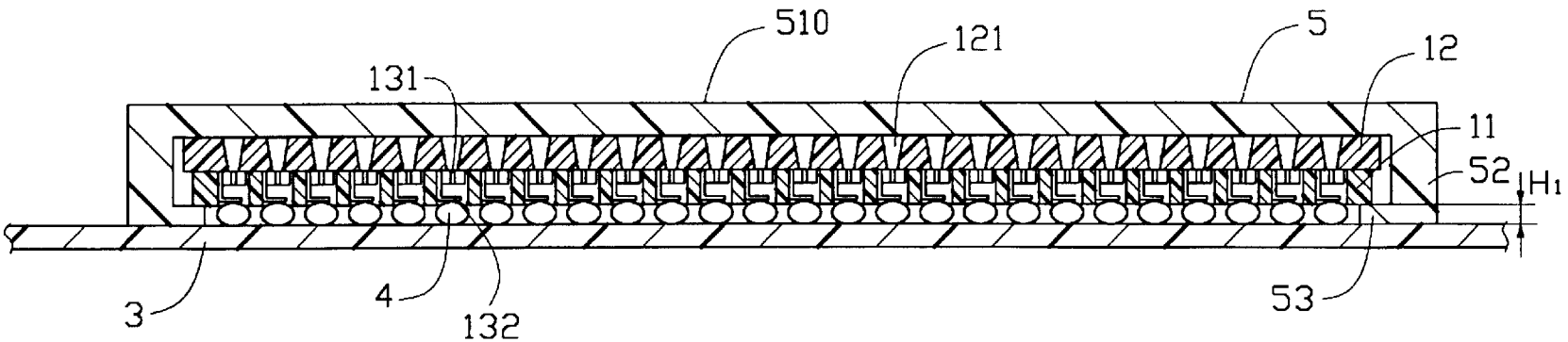
FIG. 4 is similar to FIG. 3 but showing the ZIF electrical connector attached to the circuit board after soldering.

Referring to FIG. 4, the solder balls 4 are melted and exhibit a height $H_1$ which is equal to the height $H_1$ of the stand-off portions 53. Thus, the solder balls 4 are soldered in the same plane and exhibit the same height $H_1$. If some solder balls 4 are not properly soldered to the circuit board 3, the auxiliary device 5 can be reattached to the electrical connector 1 before melting the solder balls 4 after soldering to be properly soldered to the circuit board 3. Thus, the auxiliary device 5 ensures excellent soldering quality of the electrical connector 1 to the circuit board 3 during an SMT process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted to a circuit board, comprising:

an electrical socket comprising a base, a cover slidably mounted on the base, a plurality of terminals received in the base, and a plurality of solder balls electrically interconnected between the terminals and the circuit board; and an auxiliary device comprising a body and a pair of supporting portions downwardly extending from lateral edges of the body, each supporting portion forming an inwardly extending stand-off portion, the body, the supporting portions and the stand-off portions together defining a receiving space for receiving the electrical socket, the stand-off portions each having a bottom surface spaced a predetermined distance from the circuit board before the solder balls are soldered to the circuit board and contacting the circuit board after the solder balls are soldered to the circuit board;

wherein a plurality of passageways is formed in the base for receiving corresponding terminals therein;

wherein a plurality of receiving holes is formed in the cover corresponding to the passageways for receiving contacts of a CPU module therein;

wherein each stand-off portion inwardly extends from a free end of the supporting portion and forms a bottom surface opposite to the circuit board;

wherein the electrical socket is slidably received in the auxiliary device for facilitating an assembly/disassembly process.

2. The electrical connector as claimed in claim 1, wherein the cover is slidably mounted on the base and moves in a diagonal direction relative to the base.

* * * * *